United States Patent [19]

Serrallonga Vilaseca

[11] 3,943,976

[45] Mar. 16, 1976

[54] CONTINUOUS INSERTION WEAVING MACHINE

[75] Inventor: Hilario Serrallonga Vilaseca, Barcelona, Spain

[73] Assignee: Maquinaria Textil Del Norte De Espana S.A.-Matesa, Barcelona, Spain

[22] Filed: Sept. 5, 1974

[21] Appl. No.: 503,516

Related U.S. Application Data

[63] Continuation-in-part of Ser. No. 469,885, May 14, 1974, abandoned, which is a continuation of Ser. No. 295,576, Oct. 6, 1972, abandoned.

[30] Foreign Application Priority Data

Oct. 6, 1971 Spain ..... 396118
Sept. 12, 1972 Spain ..... 406875

[52] U.S. Cl. ..... 139/12
[51] Int. Cl.[2] ..... D03D 47/26
[58] Field of Search ..... 139/12, 13, 15, 16

[56] References Cited

UNITED STATES PATENTS

| | | | |
|---|---|---|---|
| 2,144,947 | 1/1939 | Valentine | 139/12 |
| 2,799,295 | 7/1957 | Juillard et al. | 139/12 |

*Primary Examiner*—Henry S. Jaudon
*Attorney, Agent, or Firm*—Wenderoth, Lind and Ponack

[57] ABSTRACT

A continuous insertion weaving machine of the progressive shed type includes two coplanar endless chains which are supported and driven by two pinions. Coupling and uncoupling of the chains to the pinions is achieved by deflecting elements which cause a separation of the straight paths of the two chains. The chains move parallely along two shed tunnels which extend along the straight paths of both chains. The chains comprise means for moving driving elements of the shed tunnels, which driving elements, accompanied by the chains, act repeatedly in a cyclic manner within both shed tunnels.

15 Claims, 27 Drawing Figures

CONTINUOUS INSERTION WEAVING MACHINE

This is a continuation-in-part of application Ser. No. 469,885, filed May 14, 1974, now abandoned, which is a continuation of application Ser. No. 295,576, filed Oct. 6, 1972, now abandoned.

BACKGROUND OF THE INVENTION

The invention refers to a weaving machine of the so-called progressive shedding loom type, wherein a series of disadvantages of known such machines have been overcome by the provision of the following features:

a. Improved driving of the devices which insert and beat-up the weft threads between the warp threads, such devices hereinafter being referred to as "inserters".

b. The system of feeding the weft threads to the inserters, which in turn subsequently introduce the weft threads into the shed, is improved.

c. The heald actuating system which opens and closes the warp threads to allow passage of the inserters and which crosses the warp threads behind each inserter after the deposit thereby of a new weft thread, is improved.

However, before explaining in detail the characteristics of the invention which advantageously eliminate the disadvantages of known machines, and also before referring in detail to the different embodiments of the invention, in view of which even a dual weaving machine can be constructed which is capable of simultaneously producing two lengths of fabric with a minimum of additional elements, a brief explanation will be made of the characteristics as well as of the disadvantages of known machines of this type.

Presently known weaving machines of the progressive shed type are mainly constructed from a warp thread feeding roller and a roller which collects the fabric produced, such rollers being superposed and between which there is a shed tunnel wherein the warp threads are controlled by a plurality of healds which are positioned within planes which are perpendicular to the vertical planes occupied by the shafts of the rollers, and which are alternately linearly moved in directions which are also perpendicular to the planes occupied by the roller shafts.

The healds are mere elongated elements which have an opening through which the warp thread passes and which are connected in groups, each group being composed of at least two healds. The healds are superposed within each group, and comprised within the same perpendicular plane as those occupied by the shafts of the rollers.

The planes which define the position in space of each group of healds are therefore parallel to each other.

The warp threads, furthermore, after passing the corresponding healds, are driven very close to each other between two guide elements which force the warp threads to be joined from such moment onward until the fabric collecting roller is reached, whereat when operation starts the warp threads should be fixed.

The healds receive alternate opposed lineal movements within each group, so that the threads being controlled thereby are open or separated each time the healds which are driven in opposite directions away from each other, and so that the threads are subsequently crossed when the healds receive reversed movement. Before the healds are moved to opposite extreme positions, they are exactly superposed.

As can be appreciated from the fact that the warp threads are guided together after their passage through the healds, the separation and crossing of the threads, as produced by the healds, is effected from the point where the guide means force the threads to be held together.

Immediately on top of the guide means, which force the threads to be joined after being controlled by the healds, and moving within a path between such guide means and the healds, there are a plurality of inserters which are spaced from each other at short, regular intervals and which are synchronously moved. Each one of such inserters deposits a weft thread between the warp threads which, in view of the above mentioned arrangement, are separated in front of each inserter and cross behind the same, on top of the weft thread deposited thereby. Each inserter, at the same time as it deposits a weft thread, beats up the weft thread deposited by the preceding inserter, pressing the cross of warp threads thereon.

The shed tunnel is formed by the grouping of various warp threads controlled by the healds. Such shed is open when the warp threads are separated, thus permitting the passage of the weft inserter, and it is closed when the warp threads are crossed on top of the weft which has just been deposited.

Since there is, at each given moment considered, within the shed tunnel a plurality of weft inserters, of which that which is just entering the shed has all of the weft thread thereof, while that inserter which is leaving the shed has already exhausted the weft thread thereof, having deposited the same between the warp threads, and the remaining inserters have different amounts of their respective weft threads, it is clear that the groups of healds cannot act synchronously. That is, the healds cannot be displaced half towards one side and the other half towards the other side, since when the threads handled thereby are crossed, they would butt against the inserters which are interposed in their path. Consequently, the healds are progressively actuated, in a snake-shaped path, from the beginning of the shed tunnel, with the result that some groups are separated in front of the inserters while others are closed from behind, all of which takes place continuously and progressively.

In the above mentioned types of looms, the weft thread inserters are actuated by electrical or mechanical devices.

In the electrical type looms, driving is carried out by means of electromagnets functioning inside the shed, each one of which actuates a weft thread inserter element.

This system has two main inconveniences. The first relates to the weight of the electromagnets and their brackets, which results in a great inertia, reducing the speed of the machine and increasing the time necessary for braking. The other inconvenience is that, owing to the fact that the warp threads must be placed between the electro-magnet and the inserter device, they must bear the pressure between such two elements, which causes friction capable of damaging the warp thread.

In known mechanical systems, adjustment of beating up of the weft thread between inserters is effected by the individual advance of the teeth of the reed. These movements of the teeth of the reed are, in the majority of known systems, used to displace the inserters within the shed. One of the biggest problems of such systems, from the textile point of view, is that the individual movement of the teeth of the reed results in a change in density per warp of the fabric being produced, as a result of the play and wear on the teeth. Another important difficulty involves changing the density per warp of the fabric, since in order to achieve such change it is necessary to change all the elements forming the reed. Furthermore, from a mechanical point of view, serious drawbacks are caused by wear of the teeth of the reed through friction with the inserters, as well as the fact that the teeth of the reed must effect a long run or travel in order to achieve beating up of the weft thread. This is a limitation on the speed of the machine.

Furthermore, in known looms of the progressive shed type, there are various ways of feeding the weft to the inserters. However, all such known feeding systems have drawbacks which mainly reside in the fact that various inserters operate simultaneously within the shed. As a result, the inserters must be filled one after the other. Thus, the displacing movement of the weft thread is much higher when the bobbins of the inserters are to be filled than when the weft thread is to be inserted in the sheds.

A known weft feeding system uses a suction effect which draws the weft thread towards the interior of the tank with which each inserter is equipped. Thus, the thread is not wound on any bobbin whatsoever. This system has the inconvenience that the weft thread is not methodically placed within the inserter, and furthermore, when the thread is deposited in the sheds, it undergoes tension irregularities which produce defects in the fabric being produced. Another inconvenience is that derived from the speed to which the weft thread should be subjected during filling of the inserter. This makes measurement thereof difficult, and consequently makes difficult the achievement of an arrangement such that the threads stored in each of the inserters are the same and equivalent to the width of the fabric being manufactured. A further difficulty is due to the fact that since the inserters should operate one at a time at the feeding site, they have very little time in which to effect a thread loading operation. Thus, the feed mechanisms are very delicate, expensive and of short duration. Furthermore, in the inserter feed system under discussion, high quality threads should be used, since these threads are subjected to high tensions when pushed with a force which is sufficient in order to reach the high displacement speeds which are necessary.

SUMMARY OF THE INVENTION

In veiw of all these disadvantages with regard to the driving system of the weft inserters and to the feed system of the inserters, as well as to other not less important characteristics of known weaving machines of the type contemplated, among which the driving means of the healds, the manner in which such driving means are moved, and the manner in which such driving means are connected to the driving means of the inserters are important, the object of the present invention is to provide a series of modifications to the weaving machine, such modifications including the following features.

According to the invention, movement of the inserters in the interior of the shed is achieved by pressure exerted by projections provided in the teeth of the reed on pulling wheels provided in the inserter. The teeth of the reed are free and are so assembled that they can slide freely in an axial direction between stops. The teeth of the reed are subjected to reciprocating movements, and alternately travel short distances in opposite directions.

According to another feature of the invention, the reciprocating movement of the teeth of the reed is achieved by means of cams mounted on an endless chain which covers the width of the loom.

According to another feature of the invention, synchronization of the movement of the inserters with the warp threads is obtained due to the fact that the actuating cams of the healds are also mounted on the endless chain.

According to another feature of the invention, the driving of the teeth of the reed and of the healds is positive in both directions. This is obtained through the provision of the endless chain.

According to another feature of the invention, the guide elements and the support for the teeth of the reed and the healds, are substantially flat, fixed plates which are parallelly arranged and regularly spaced from each other.

According to another feature of the invention, the chains which draw carriers supporting the cams which actuate the healds and the teeth of the reed, can be mutually coupled to each other, so that they are moved together by common drive and driven pinions.

According to another feature of the invention, the bobbins of the inserters are filled by means of telescopic arms which turn radially about the same shafts to which the pinions which drive the chains drawing the actuating cams of the teeth of the reed and the healds are secured. Such radial telescopic arms move the inserters along tracks or rails which guide them from the time that an inserter leaves the shed until such inserter is again introduced into the shed.

According to another feature of the invention, the free end of each telescopic arm is provided with a freely rotating head having a crown which at one side thereof, adapts to a conical core of the bobbin of the inserter. The crown is provided with at least one tooth which meshes with one of several grooves provided in the bobbin, thereby forcing the bobbin to turn at opposite side thereof, the crown has a half ball-and-socket with a hole in the upper part thereof on which the crown can oscilate and held together by a flexible bellow which allows it to oscilate and avoids the loss of air pressure. A pinion forms a part of the head. Such pinion, when engaging with a semi-circular toothed track which is secured to the machine, forces the head assembly to turn.

According to another feature of the invention, the tooth track can be varied and adjusted, so that the bobbin of the inserter will make more or fewer turns during the time provided for refilling of the bobbin. Thus, the length of the weft thread wound on the bobbin may be adjusted, depending on the width of the fabric being produced.

According to another feature of the invention, each telescopic arm is provided with at least one weft thread feeding inlet, together with a corresponding weft thread guide.

According to another feature of the invention each telescopic arm is hollow throughout the length thereof, so that an air current can circulate in the outer portion thereof. Each arm, at the end thereof fixed to the machine assembly, is connected to a negative air pressure chamber, thus establishing a suction at the free end, in order to retain the free end of the weft thread during a time when weft threads are not being fed to the inserters.

According to another feature of the invention, the free end of each radial telescopic arm is provided with ends which can suitably be coupled to cavities with which the chassis of the weft inserters are provided in such a way that the inserters are forced to move when the weft thread is loaded, thus being obligated to carry out the work for which the weft thread feeding and measuring system in known weaving machines provided with multiple inserters has been designed.

BRIEF DESCRIPTION OF THE DRAWINGS

For a better understanding of the changes and modifications contemplated by the invention, the attached drawings, taken with the accompanying description, explain the characteristics of the invention with relation to a specific embodiment involving a dual weaving machine. However, it will be understood that when identical structural and functional principles are used, the scope of the present invention encompasses a simple weaving machine wherein only one length of fabric is produced instead of two, as is illustrated in the drawings, wherein.

DETAILED DESCRIPTION OF THE INVENTION

Figure 1:
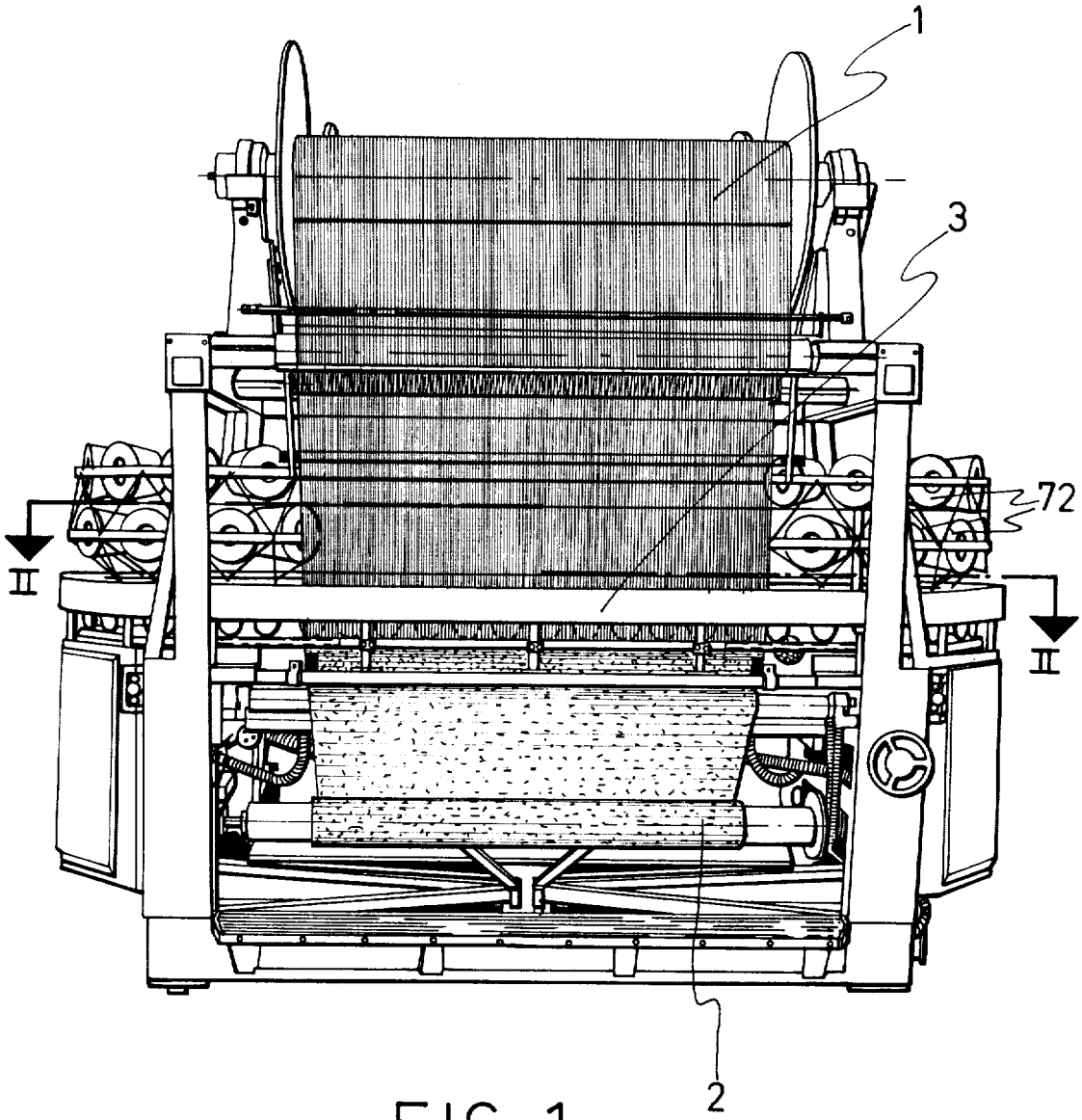
FIG. 1 is an elevational view of a dual weaving machine of the continuous insertion progressive shed type which incorporates the characteristics of the invention.

Referring now to the drawings, and with the above discussion in mind, the invention relates to a weaving machine of the type having continuous insertion through a progressive shed.

FIG. 1 illustrates a complete machine of the above type. The machine comprises a warp thread beam 1, a woven fabric beam 2, and a shed tunnel 3 in which the warp threads are controlled by a plurality of healds which are positioned within planes perpendicular to the warp, and which move linearly in opposite directions in planes perpendicular to the warp.

In the conventional manner, inserters are combined with the healds and travel along the interior of the shed, at regularly spaced intervals and with synchronous movement. Each of the inserters deposits a weft thread between the warp threads which open up in front of each inserter and cross at the back of such inserter, on top of the weft thread deposited thereby.

The changes contemplated by the invention permit, among other things, the construction of a dual weaving machine including a minimum of additional operative elements, and reside in three main features, i.e. the manner in which the inserters are actuated, the manner in which the healds are activated, and the manner in which the weft threads are fed to the inserters.

According to the invention, the shed tunnel 3, the external casing only of which has been represented in FIG. 1, has dual tunnels (see FIG. 2), each of which has within its interior two alignments of shield plates. These alignments of plates have both been labeled 4 in FIGS. 2, 3, 18 and 20, and the pluralities of plates forming the alignments 4 have been illustrated in detail in FIGS. 4, 5, 18, 19 and 20, wherein they have been labeled 5 and 6, respectively.

The plates 5 and 6 are all equal in configuration and are symmetrically arranged. The plates 5 of one alignment 4 are coplanar, in a transverse direction, with the plates 6 of the other alignment 4.

Figure 5:
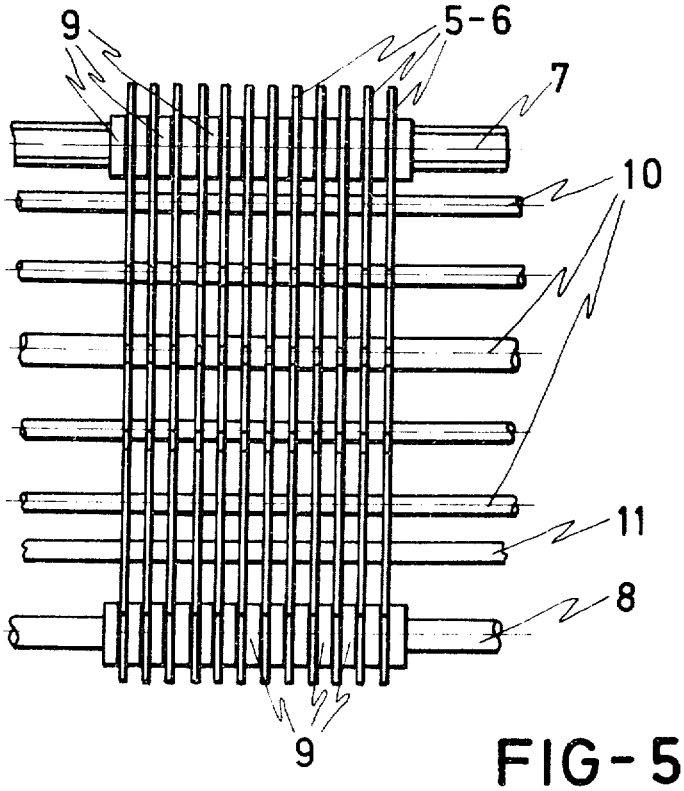
FIG. 5 is a side elevational, schematic view of a portion of the group of plates illustrated in FIG. 4.

The plates, as shown in FIG. 5, are regularly spaced from each other, by means of blocking rods 7 and 8 which transverse the plates through holes 12 and 13 provided at the upper and lower plate ends, respectively. Separators 9, which maintain the plates regularly spaced, are positioned on the rods 7 and 8.

Plates 5 and 6 furthermore have extending therethrough a plurality of passing holes 14 which are traversed by bars 10. The plates also have, at the bottoms thereof, rectangular windows 15 which are traversed by a bar 11 having the same section and dimensions as windows 15.

Figure 6:
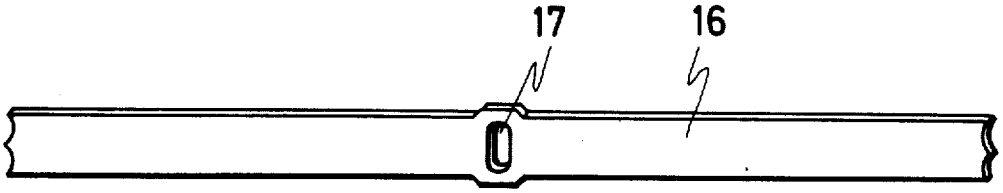
FIG. 6 is a perspective view of a heald.

The healds 16, one of which is shown in perpsective in FIG. 6, are made of the same material and have the same thickness as plates 5 and 6 and are mounted successively in groups between adjacent plates 5 and 6. The separating rods 10 maintain the levels or groups of healds separated from each other. The relative positions occupied by the healds 16, in relation to the plates 5 and 6, can be seen in FIGS. 19 and 20.

Each heald has an eye 17 through which a warp thread passes. Each heald 16 handles one or more warp threads of the fabric, and the movement of the warp threads transverse to the shed tunnel, due to transverse movement of the healds, causes crossing and uncrossing of the warp threads, or opening and closing of the shed, which with the insertion of the weft threads, produces weaving of the fabric.

The teeth of the reed are mounted on bars 11 between successive pairs of separating plates 5 and 6 adjacent the lower parts thereof. The purpose of the reed is to maintain the warp threads of the healds separated, to provide a guide for the inserters, and to activate the inserters so that they advance at the same rate as the healds.

Figure 7:
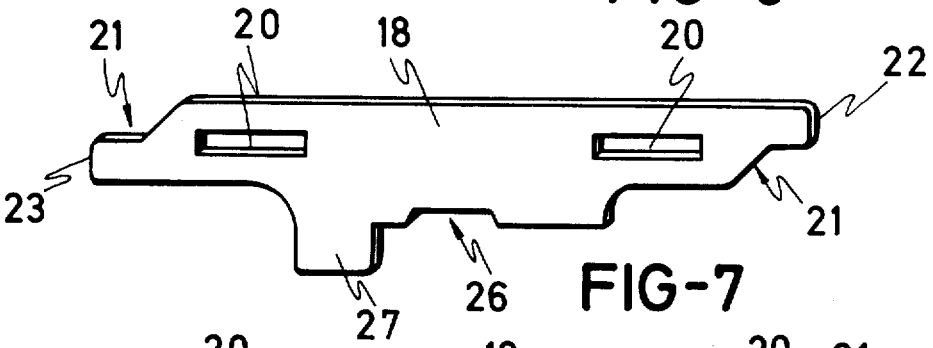
FIGS. 7 and 8 are perspective views of the two types of teeth of the reed used in the loom and which are symmetric in configuration to each other.
Figure 8:
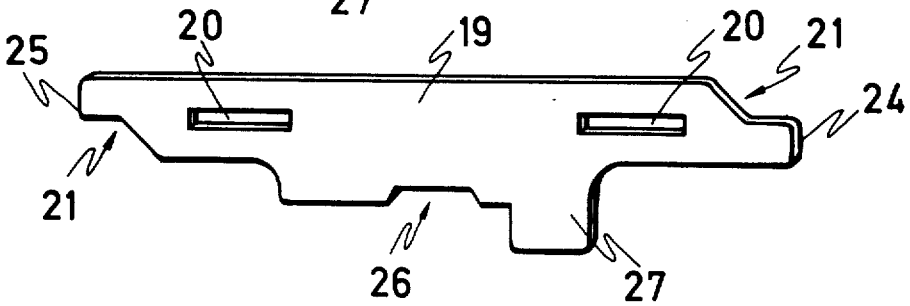

The teeth of the reed used in the loom according to the invention are represented in detail in FIGS. 7 and 8, from which it can be seen that they are of two types, equal in configuration, but mirror images of each other.

Figure 9:
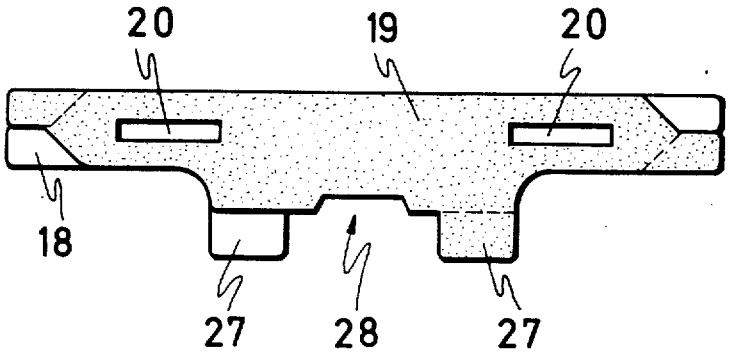
FIG. 9 is an elevation showing the relative positions occupied by the two correlative teeth of the reed, represented in FIGS. 7 and 8 when they are superposed in an operative position.

The teeth 18 and 19 are alternately arranged, so that when superposed, they form a configuration as illustrated in FIG. 9.

In FIGS. 7, 8 and 9 it can be seen that each member 18 and 19 has two elongated orifices 20 which correspond, with regard to position, to orifices 15 of the plates 5 and 6, although orifices 20 are longer in the longitudinal dimension thereof then orifices 15 and the rectangular bars 11. Therefore, each member 18 and 19 can be displaced transverse of the shed tunnel, between two extreme positions.

The teeth of the reed have recesses 21 in the ends thereof, thus forming cam contacting ends 22, 23, 24 and 25, as will subsequently be discussed.

Each member 18 and 19 has, in the lower central portion thereof, a groove 26, and adjacent such groove, a downwardly extending projection 27.

As seen in FIG. 9, the grooves 26 and the projections 27 of the members 18 and 19 cooperate to form a channel 28 which acts as a support or rail for pressure wheels of the inserters. The channel 28 is partially defined by the projections 27 which, upon transverse movement of members 18 and 19, cause advancement of the inserters.

Figure 10:
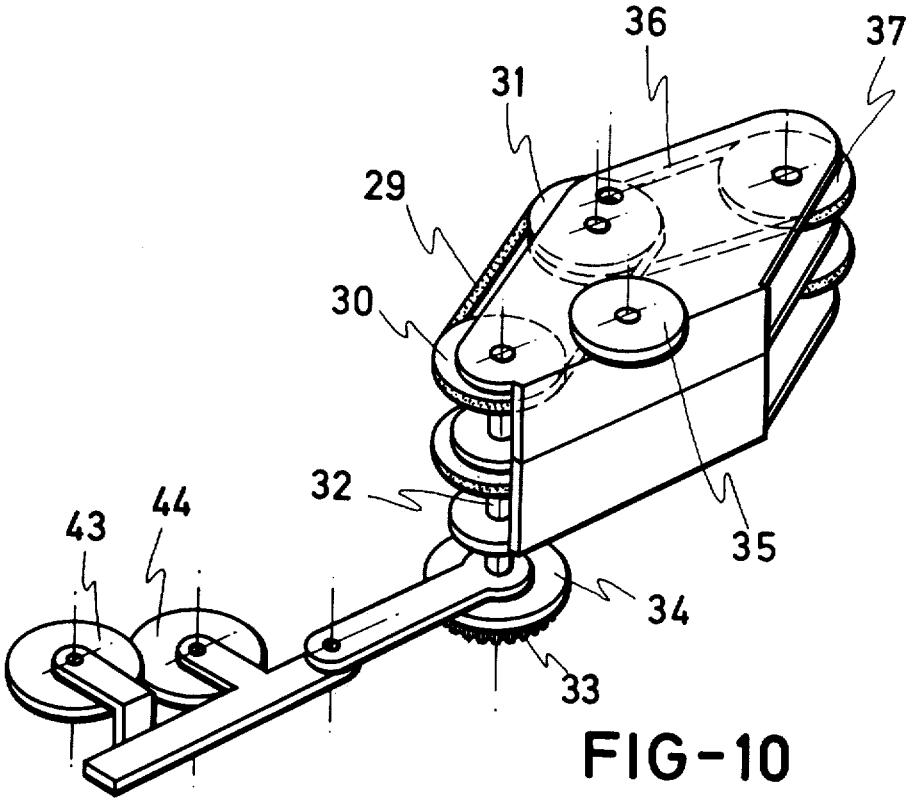
FIG. 10 is a perspective view of one of the carriers supporting heald activating cams and teeth of the reed activating cams.
Figure 11:
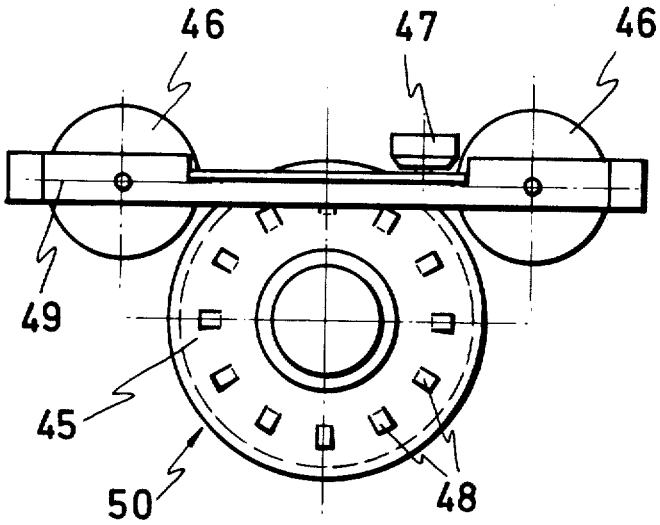
FIG. 11 is a side elevational view of one of the inserters used in the machine made according to the invention.
Figure 12:
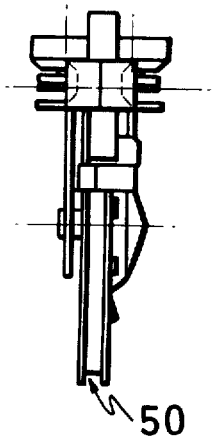
FIG. 12 is a front elevational view of the inserter of FIG. 11.
Figure 13:
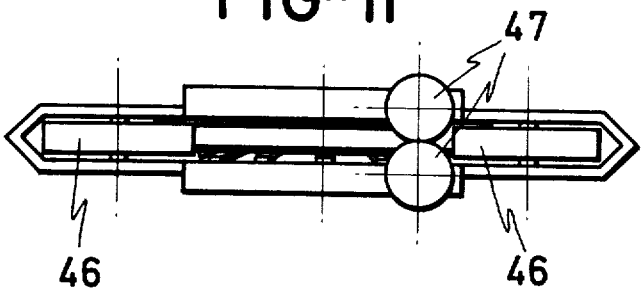
FIG. 13 is an upper plan view of the inserter of FIG. 11.
Figure 14:
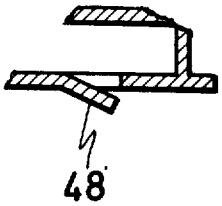
FIG. 14 is an enlarged sectional detail view of a portion of the winding bobbin of the inserter.
Figure 15:
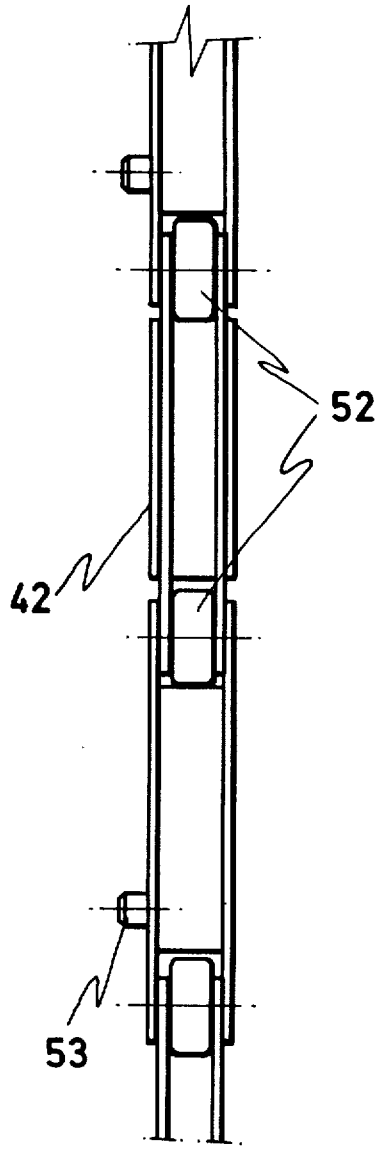
FIG. 15 is an elevational view of a portion of the chain which is used according to the invention to pull the carriers supporting the heald and the teeth of the reed activating cams.
Figure 20:
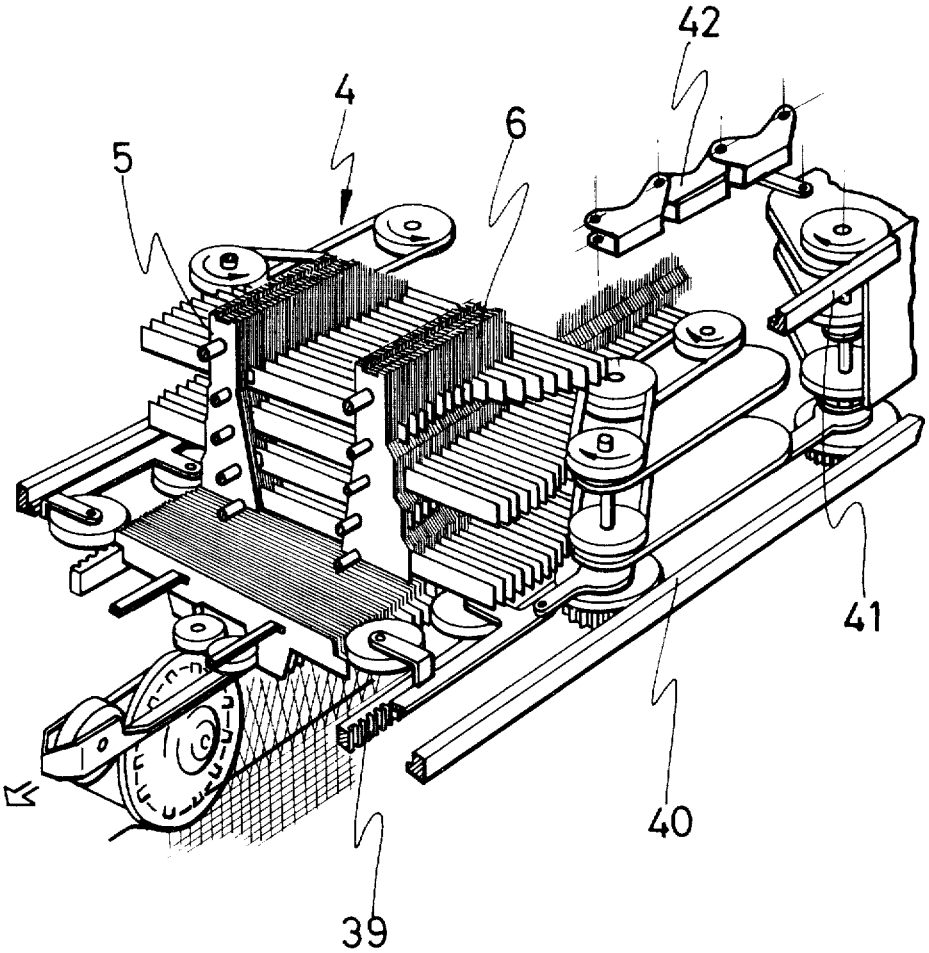
FIG. 20 is a perspective view of a portion of the shed tunnel, the cover thereof having been omitted so that its construction and mode of operating can be better seen.
Figure 21:
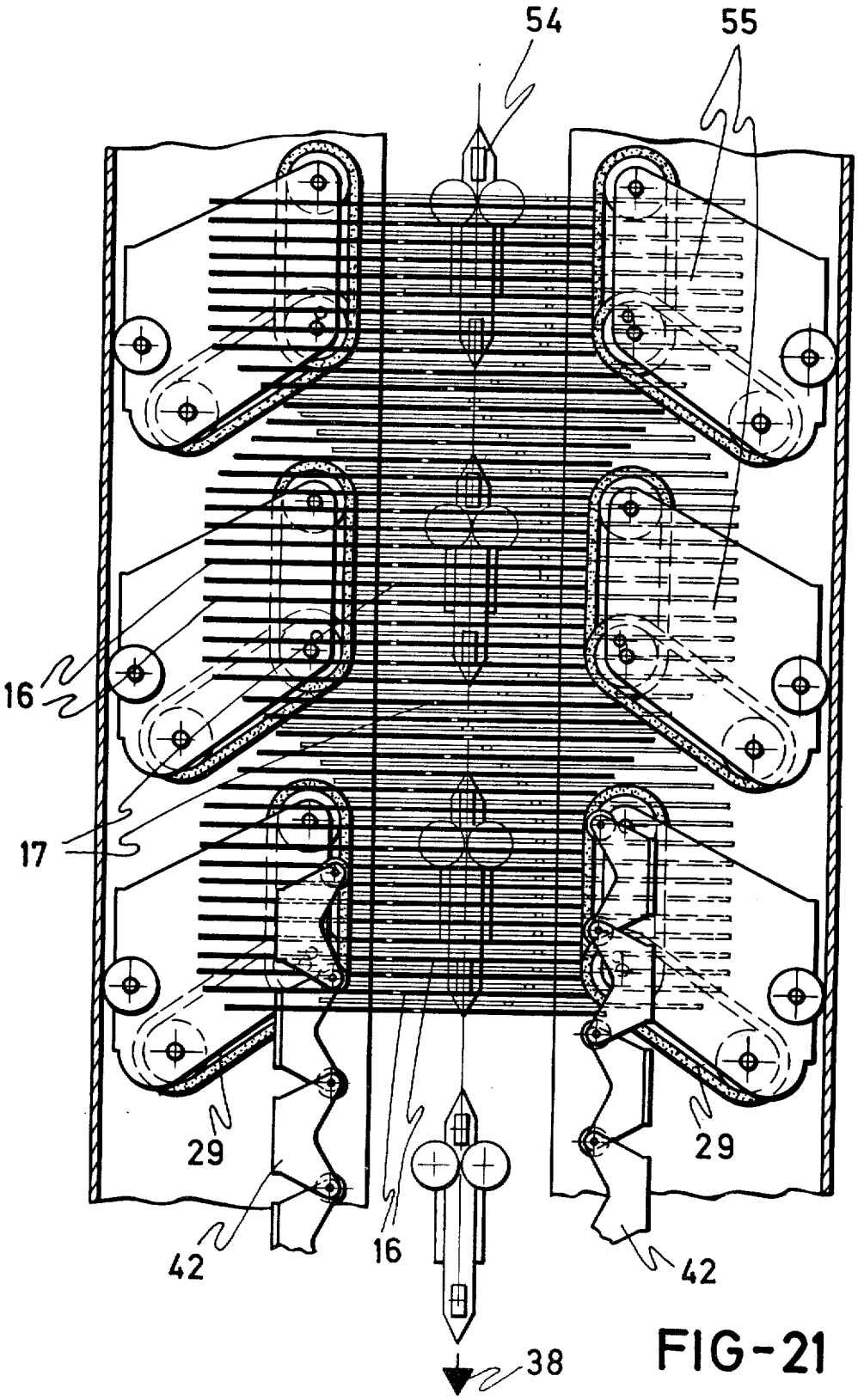
FIG. 21 is an upper plan view of a portion of the shed tunnel, the upper part of the casing of the tunnel having been omitted so that the relative arrangement which, at each given moment, is occupied by the cam rails, the inserters and the healds, can be clearly seen.

Driving of the healds is carried out by cam carriers, one of which is illustrated in FIG. 10, and several of which incorporated in the assembly in operative positions are illustrated in FIGS. 20 and 21. The carriers move parallel to the shed tunnel, along both sides of each tunnel thereof. Cams mounted on each carrier successively push the healds transversally of the tunnel. For each unit of length, e.g. one meter, of the shed tunnel there are provided a specific number, e.g. eight, pairs of cam carriers, forming two alignments, one on each side of each tunnel (see especially FIG. 21).

The carriers for each tunnel advance simultaneously and in parallel in the same direction, and the cams of the carriers on one side approach different levels of the healds then the cam of the respective carriers on the other side. Thus, each heald during operation is inscribed or moved continuously in a snake-like manner.

Each carrier incorporates, depending on the type of weaving involved, a specific number of cams. It should be emphasized that each cam of each carrier is formed by a band or endless belt 29 which turns between two pulleys 30 and 31. The relative spacing of the axes of the pair of pulleys 30 and 31 with respect to the longitudinal direction of the shed tunnel determines the path and amount of displacement of each heald (see again FIG. 21). When the displacement direction of the carriers is that indicated by arrow 38, the manner in which the belts 29 displace the healds located at different levels can be seen.

Figure 19:
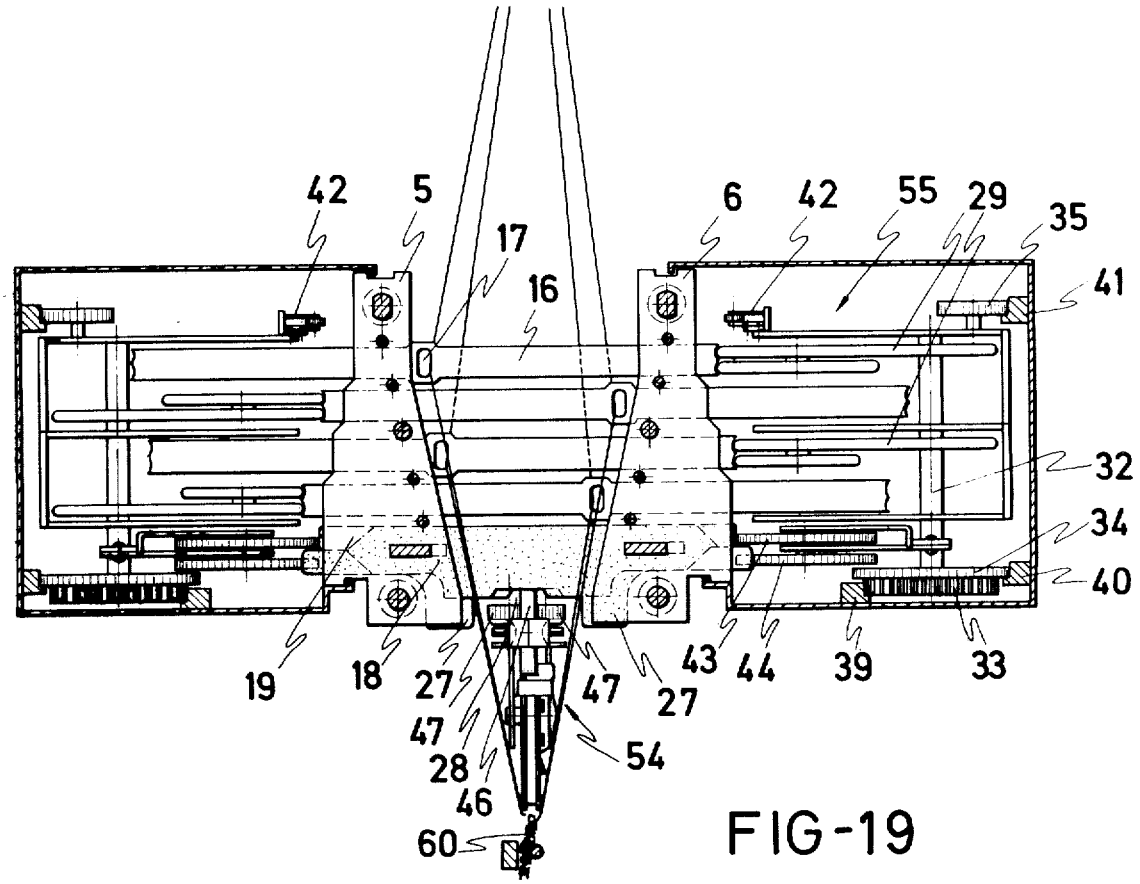
FIG. 19 is a cross-sectional view of the shed tunnel taken along lines XIX—XIX of FIG. 2.

Grooves formed in the ends of each heald (see FIG. 6) allow the heald ends to be efficiently engaged both by cam belts 29 and 36 (see also FIG. 19).

In order to impart movement to the pulleys 30 and 31 of each cam carrier, the shaft 32 of one of the pulleys has an extension to which a small pinion 33 is secured.

Pinion 33 meshes with a rack 39 (see for example FIG. 20) one of which is fixed and arranged along each side of each tunnel of the shed tunnel. As a result, when the carrier advances by being moved by a chain 42, as will subsequently be discussed, rotation of pinion 32 causes pulley 30 and belt 29 to be rotated.

The carriers are furthermore guided throughout their travel and thus are provided with tracking elements such as wheels 34 and 35 which ride over cooperative tracks 40 and 41, as shown in FIG. 20, tracks 40 and 41 extending along each side of each tunnel.

The teeth of the reed are activated simultaneously with the healds by other cams, i.e. reed cams, which are mounted on the carriers and which are formed by two wheels 43 and 44 which are placed at different levels.

The carrier represented in FIG. 10 has two heald cams which correspond to two of the four heald levels and two reed cams. It can easily be understood however, that the number of cams of each carrier can be modified, depending on the number of levels of healds included in the shed tunnel. Each heald cam includes an endless belt to maintain the shed open for a sufficient time to enable the inserter to pass.

The inserters move simultaneously with the carriers. The inserters are shown in detail in FIGS. 11, 12, 13 and 14, and in an operative position within the shed in FIGS. 19, 20, 21 and 27.

The number of inserters corresponds to the number of pairs of carriers (8 per meter in a preferred embodiment).

The purpose of each inserter is to introduce a weft thread into the interior of the shed, and at the same time to perform beating up of the weft thread deposited by the proceeding inserter against crossed warp threads at a moment when the shed is open.

The inserter is advanced by being pushed by projections 27 during the transverse, cyclic and inverse displacement of the teeth of the reed caused by wheels 43 and 44 upon movement of the carriers.

The inserters, as can be appreciated from the above discussion, replace the shuttle and the batten or frame of a conventional loom, wherein the reed is employed to perform beating up.

The inserter (see FIGS. 11 to 14) includes a weft thread bobbin 45, two pressure wheels 46, two pulling wheels 47, and a frame 49 mounting such elements. The weft bobbin 45 has a plurality of raised flanges 48 (see especially FIG. 14) wherein the end of the weft thread to be wound is hooked, by means which will subsequently be explained. The periphery 50 of bobbin 45 is purposely designed to beat up the weft thread deposited by a preceeding inserter.

The pressure wheels 46 circulate through the channel 28 formed by the grooves 26 in the teeth of the reed (see FIGS. 7, 8 and 9).

The pulling wheels 47 are contacted by the projections 27 of the teeth of the reed (see FIGS. 7, 8 and 9), thus resulting in a pushing action which displaces the inserter along the shed tunnel, at the same rate as the carriers, as can particularly be seen in FIG. 21.

In other words, and with particular reference to FIGS. 7 through 9, 19 and 20, as the two carriers on opposite sides of each tunnel move therealong, the upper reed cam wheels 43 contact cam contacting edges 22 and 25 of members 18 and 19, respectively, thereby forcing members 18 and 19 away from each other. Thereafter, the lower reed cam wheels 43 contact the cam contacting edges 23 and 24 of members 18 and 19, respectively, thereby forcing members 18 and 19 inwardly toward each other. This results in projections 27 contacting the pulling wheels 47 of the respective inserter and moving the inserter along the tunnel along with the respective carriers.

In order to describe in detail the manner in which the cam carriers are moved, thus causing the transversal cyclic displacement of the healds and the advance of the inserters, reference will be made to FIGS. 2, 3, 15, 16, 20, 21 and 22 which illustrate the chains which move the carriers, the pinions activating the chains, and the means for allowing the chains to be separated within the tunnels and to be rejoined to each other so as to be moved together by the pinions.

At adjacent ends of each tunnel (two tunnels since the weaving machine described id dual) there is a pinion. One of the two pinions is visible in FIG. 2, although the position occupied by the other pinion will be understood as being under the frame carrying the thread bobbins shown at the lefthand side of the drawing. Around the two pinions are mounted two chains 42, which are particularly visible in FIGS. 3 and 22. The two chains each have a singular construction and are capable of being complemented, with the links of one chain meshing with the links of the other chain, so that the two chains may be moved as a single element by the pinions (see FIG. 16).

Wedges 51 are provided at each end of each tunnel to separate the two portions of the dual chain within the length of each tunnel, and determine the amount or distance of such separation. One of the wedges 51 can be seen in FIG. 3. The tapered end of the wedge also allows the two chains to be joined at the end of the tunnel, i.e. at the point at which the dual chain starts to be meshed with the pinion.

Figure 3:
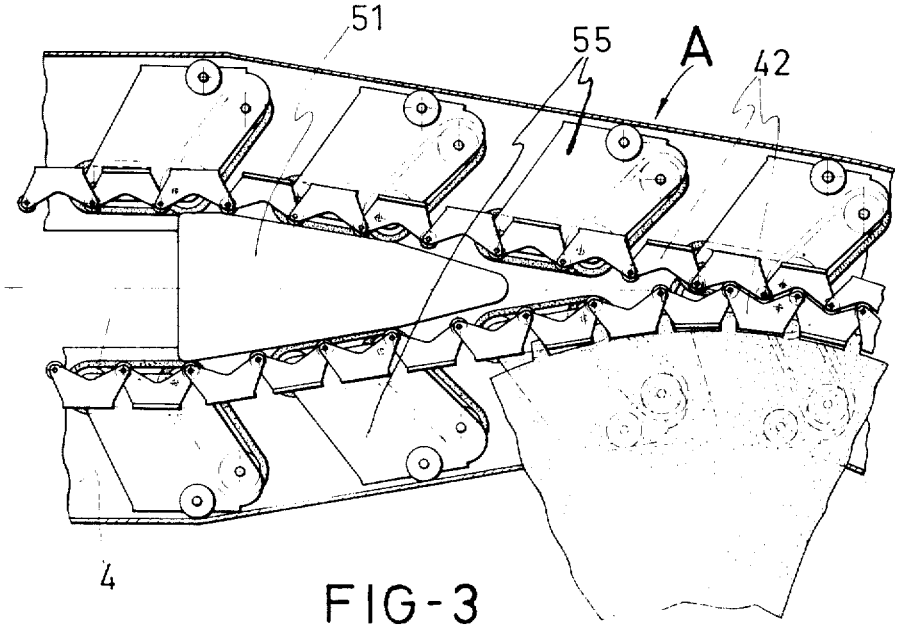
FIG. 3 is an enlarged detail view of the portion of FIG. 2 which has been designated by the letter A.
Figure 4:
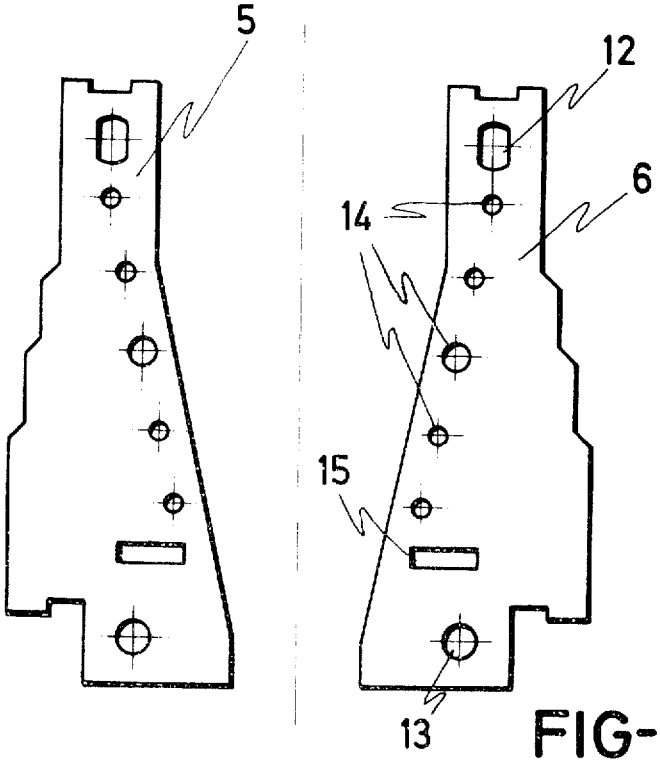
FIG. 4 is a plan view of the separating plates which act as guide means for the various groups of healds and for the teeth of the reed which move the warp threads and the inserters of the weft threads; respectively.
Figure 22:
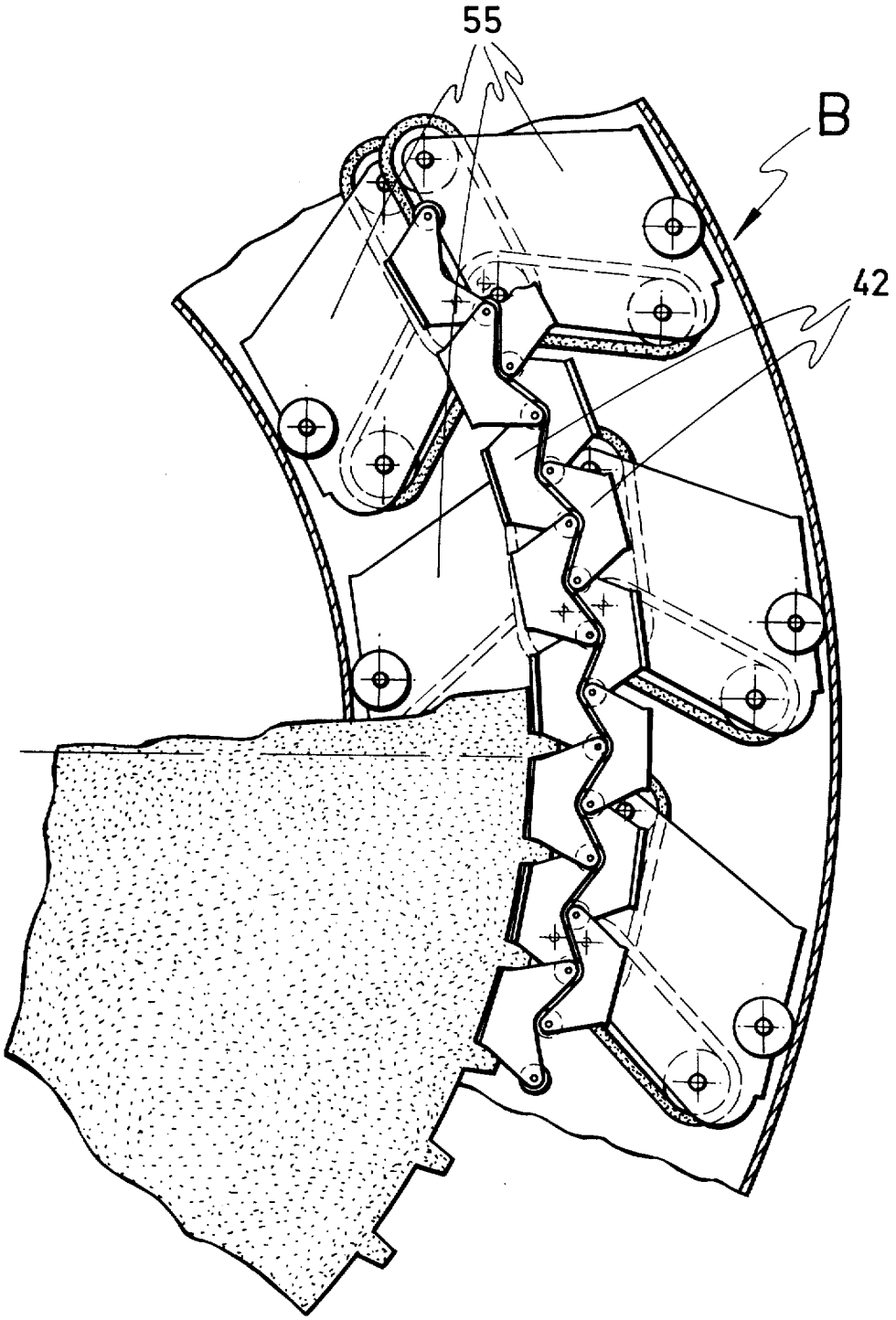
FIG. 22 is an enlarged upper plan view of the portion of the shed tunnel which is indicated with the letter B in FIG. 2.

FIG. 3 clearly illustrates how the two portions of the dual chain are separated from each other, due to the intervention of the wedges 51, in the space between the two pinions. FIG. 22, on the contrary, illustrates how the chains are coupled to each other around the pinions.

Figure 16:
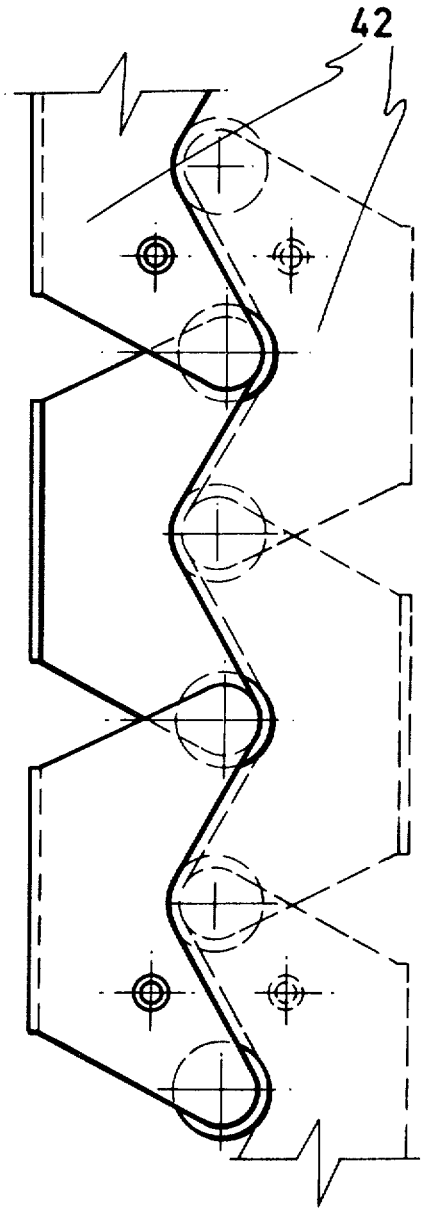
FIG. 16 is a plan view illustrating the way in which the chains are coupled to each other.

The specific construction, generally in the shape of a V formed by end peaks separating a valley, of the links of each chain, as well as the way in which the two chains are coupled to each other, can be seen in FIG. 16. In this figure, as well as in FIG. 15, it can be seen that adjacent links are joined at end peaks by means of rollers 52, which when the two chains are joined contact the central zone or valley of the opposed links of the other chain, thus avoiding friction. Alternate links of each chain are provided with studs 53 to which the cam carriers are fixed. Thus, movement of the chains causes movement of the carriers.

The time during which each pair of carriers moves past the pinions which move the chain, is used by the respective inserter (which advances simultaneously with the carriers but is moved by independent means as explained below) to be rewound with weft thread.

The travel of the cam carrier, as well as that of the inserters, around the periphery of the pinions is facilitated by special guides which are provided as a prolongation of the tracks provided at both sides of the tunnels. These guides furthermore aid in feeding the weft thread to the inserters while they travel along the guides.

Between the entrance of the tunnel and the exit of the feeding devices of the inserters, there is provided a thread cutting element.

Figure 17:
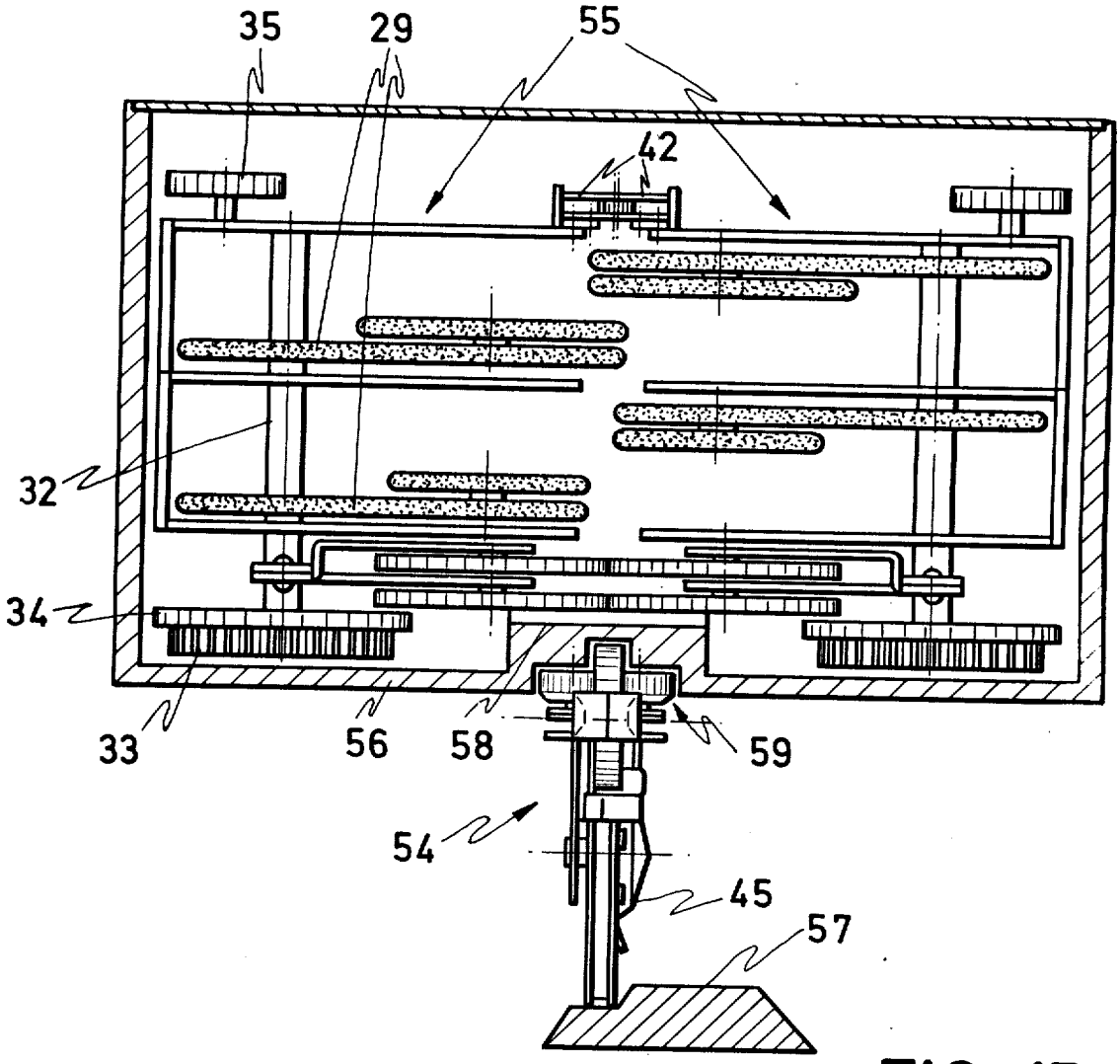
FIG. 17 is a schematic cross-sectional view of the shed tunnel, taken along lines XVII—XVII of FIG. 2.

FIG. 17 shows the guides which help guide the cam carriers and the inserters around the periphery of the pinions which move the chains. There is shown a front view of an inserter 54 positioned between an upper guide 56 and a lower guide 57. The upper guide 56 also guides the cam carriers 55. Upper guide 56 has a gliding surface 58 of the guide. The upper guide 56 allows the two carriers of each carrier pair to be in contact, as they are forced together by the two chains being joined together. A groove 59, in which the pressure wheels of the inserters are housed, is formed in the lower surface of the upper guide 56. The bobbin 45 of the inserter rests on the lower guide 57.

It should be emphasized that the gliding surface glider 58, arranged at the upper part of guide 56, can receive directly thereon the pairs of reed cams or wheels of each pair of carriers, thus forming a track of antifrictional material, to facilitate sliding.

Figure 18:
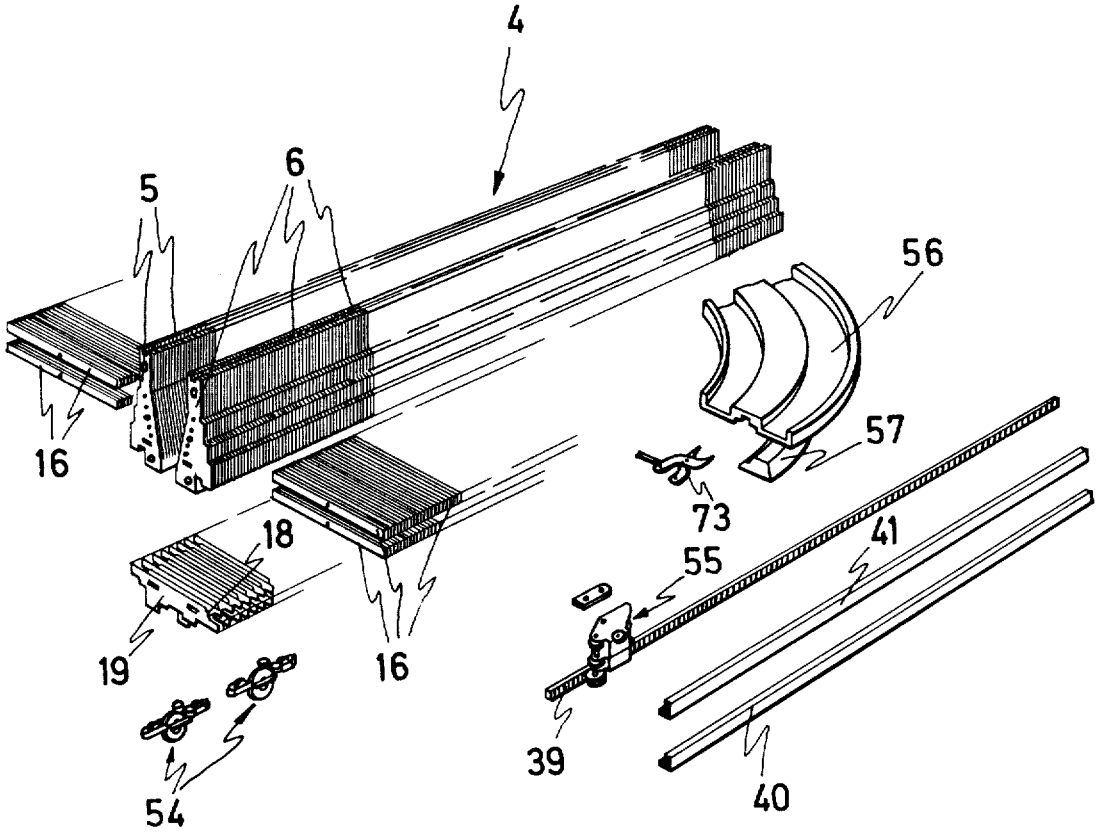
FIG. 18 is a perspective view of a coupling projection of the main elements of which the shed tunnel of the weaving machine is composed.

FIG. 18 illustrates a shed tunnel, a cam carrier 55 (together with the connecting element to the drawing chain, not represented), the rack 39 and the guides 40 and 41 of the cam carrier, inserters 54, various teeth of the reed 18 and 19, a group of healds 16 and a pair of alignments 4 of plates 5 and 6 which define the length of the shed tunnel. Portions of the semi-circular guides 56 and 57 are also represented, which guides are provided below the chain pulling pinions.

FIG. 19 shows the separating plates 5 and 6, the healds 16, the teeth of the reed 18 and 19, the warp threads, the cam carriers 55 with their heald and reed cams, driving pinions 33, the rack 39 and tracking means 34 and 35. Also, the casing which protects both sides of the shed tunnel and the carriers can be clearly seen. Below the teeth of the reed 18 and 19, the inserter 54 can be seen arranged between the teeth and the fabric 60.

FIG. 19 clearly shows how carriers 55, each one of which has two heald cams 29 situated at different levels, act on the alternate levels of healds 16, in such a way that cams 29 displace the healds 16 in opposite directions, opening the healds in order to allow passage of the inserter (i.e. open shed position which is that represented in the FIG. 19) and closing the healds behind the inserter and crossing the warp threads on top of the weft thread deposited by the inserter (i.e. at the functional moment following that illustrated).

This functioning of the cam carriers can be even better understood from FIG. 20 which corresponds to a portion of the shed tunnel seen in perspective. It will be seen that the healds situated at the same level, whether they are under the action of the cam of a given carrier or under the action of a respective cam of the carrier situated at the opposite side of the shed tunnel, are moved towards one side or the other of the tunnel.

FIGS. 19 and 20 likewise illustrate how the teeth of the reed, due to their peculiar construction and to the arrangement of the assembly as well as to the combined action of the cams 43 and 44 of each pair of carriers, are laterally alternately reciprocated, thereby imparting forward movement to the inserter 54, due to the pressure exerted by the projections 27 of the teeth of the reed on the pulling wheets 47 of the inserter.

From FIG. 21 it can be seen that the cam carriers operate in pairs, an inserter always being positioned between each pair. The shed is opened immediately before the inserter and closed immediately thereafter, as indicated by the snake-like or semi-sinusoidal lines formed by the eyes 17 of the healds 16.

As the chains 42 advance, belts 36 of carriers 35 pass along the shed tunnel and contact the ends of the healds 16, thus maintaining the same in the positions thereof established by the respective cam belts 29, until the inserters pass thereby.

Simultaneously, the reed cams (not visible in FIG. 21) move the teeth of the reed inwardly, so that the projections 27 push the pulling wheels 47 of the inserter 54, thus causing the inserter to advance. With this advance, a weft thread is placed between the warp threads, and beating up of the weft thread inserted by the preceding inserter is produced.

Figure 27:
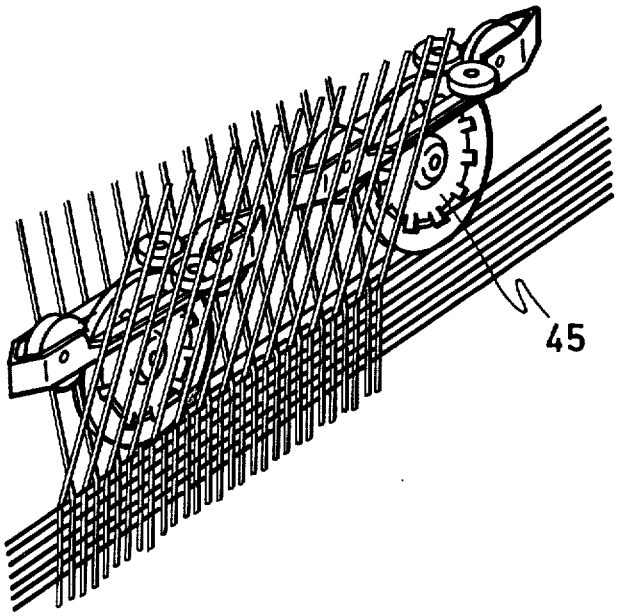
FIG. 27 is a schematic perspective view illustrating the manner in which the inserters are inserted and the manner in which they function within the shed.

The specific manner in which the inserters function within the shed, each one depositing its weft thread between the warp threads, while also beating up the weft thread deposited by the preceding inserter, can clearly be seen from the schematic view represented in FIG. 27.

Feeding of the weft thread to the inserters is carried out by means of the assembly of elements shown in FIGS. 23 to 26.

Figure 2:
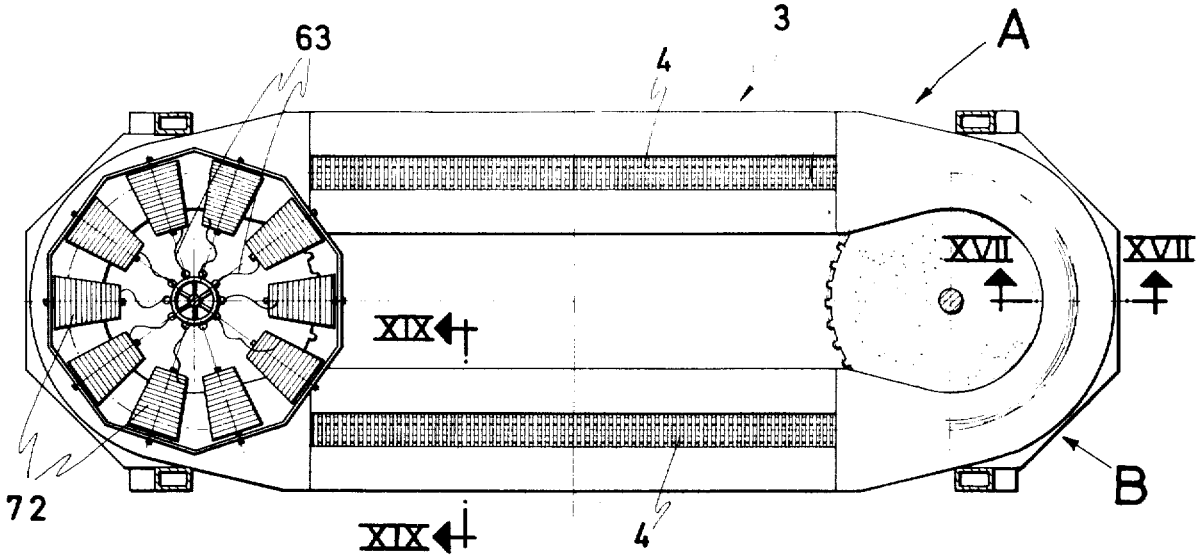
FIG. 2 is a cross-sectional view of the machine, taken on lines II—II of FIG. 1.
Figure 23:
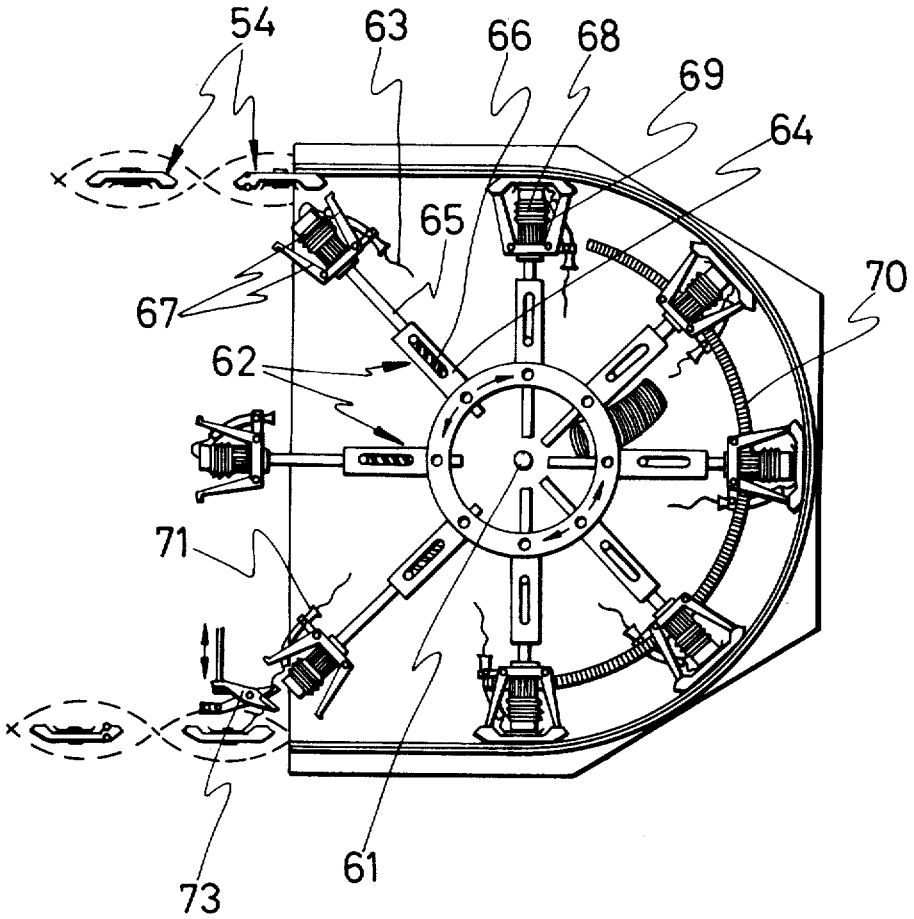
FIG. 23 is a plan view, at the shed tunnel level, of the system for feeding the weft threads to the inserters.

FIG. 23 illustrates a shaft 61, which is the shaft of the chain pulling pinion shown on the right-hand side of FIG. 2.

Mounted around shaft 61 are a plurality of radial arms 62, each of which is provided with means to be coupled to an inserter. Each inserter 54 is contacted and carried by one of the arms 62 when it leaves one of the shed tunnels. Then the inserter 54 is displaced by arm 62, which also carries the end of a thread 63 which will be fed to bobbin 45 of the inserter.

Each arm 62 is comprised of two telescopically coupled portions 64 and 65, one 64 of which is fixed, while the other 65 is urged radially outwardly by spring 66. Each arm, when not in contact with a respective inserter, is longer than the radius of the semi-circular portion of the path of the inserter from the time when it leaves the shed tunnel until it enters the opposite shed tunnel.

Each arm 62 has, at the forward end thereof, a fork 67 which bears against the frame of the respective inserter and thereby moves the inserter in the semi-circular path. Between the arms of the fork there is positioned a rotating head 68 and a pinion 69 integral therewith.

The pinion 69 of each arm 62 meshes with a substantially semi-circular rack 70 provided along the curvilinear path followed by the pinions. Thus, pinion 69 rotates, thereby causing the head 68 to rotate. When the fork 67 bears against the frame of the inserter 54, head 68 is coupled to the bobbin 45 of the inserter 54.

In each arm 62 there is installed a thread guide 71, by means of which a weft thread 63 is drawn from a storage bobbin 72 provided in an upper frame, one bobbin 72 being provided for each of the arms.

Figure 26:
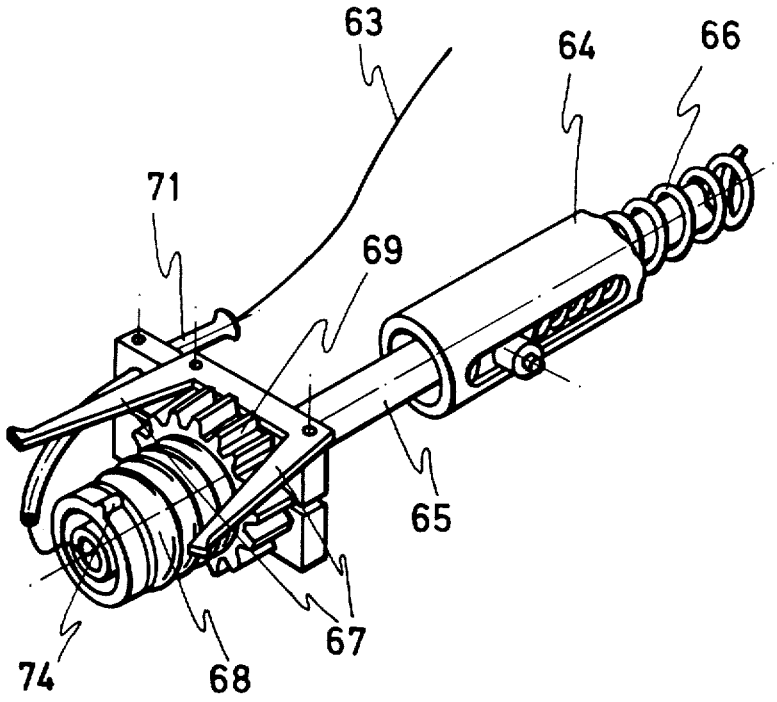
FIG. 26 is an enlarged perspective view of one of the arms which constitute the base of the system for feeding the weft threads to the inserters.

The weft thread 63, after having passed through the thread guide 71, is drawn into a hollow end of the rotating head 68, as shown particularly in FIG. 26. The hollow end of head 68 communicates through portion 65 of the arm, which is also hollow, with a source of reduced pressure (not shown).

As a result of the above arrangement, when the head 68 is coupled to the bobbin 45 of the inserter 54, a portion of the thread 63 is positioned in the angular path of the raised flanges 48 on the bobbin 45. Thus, when the bobbin 45 starts to rotate due to coupling engagement with rotating head 68, and as a result of the meshing of pinion 69 with the rack 70, the thread 63 is grasped by flange 48 and wound on the bobbin.

At the end of the travel of pinion 69 along the rack 70, the head 68 stops rotating and thread is no longer wound on the bobbin. A cutting element 73, shown in FIGS. 18 and 23, cuts the thread when the inserter is transferred from the corresponding arm 62 and is picked up by the teeth of the reed and starts to move along the new shed tunnel.

Figure 24:
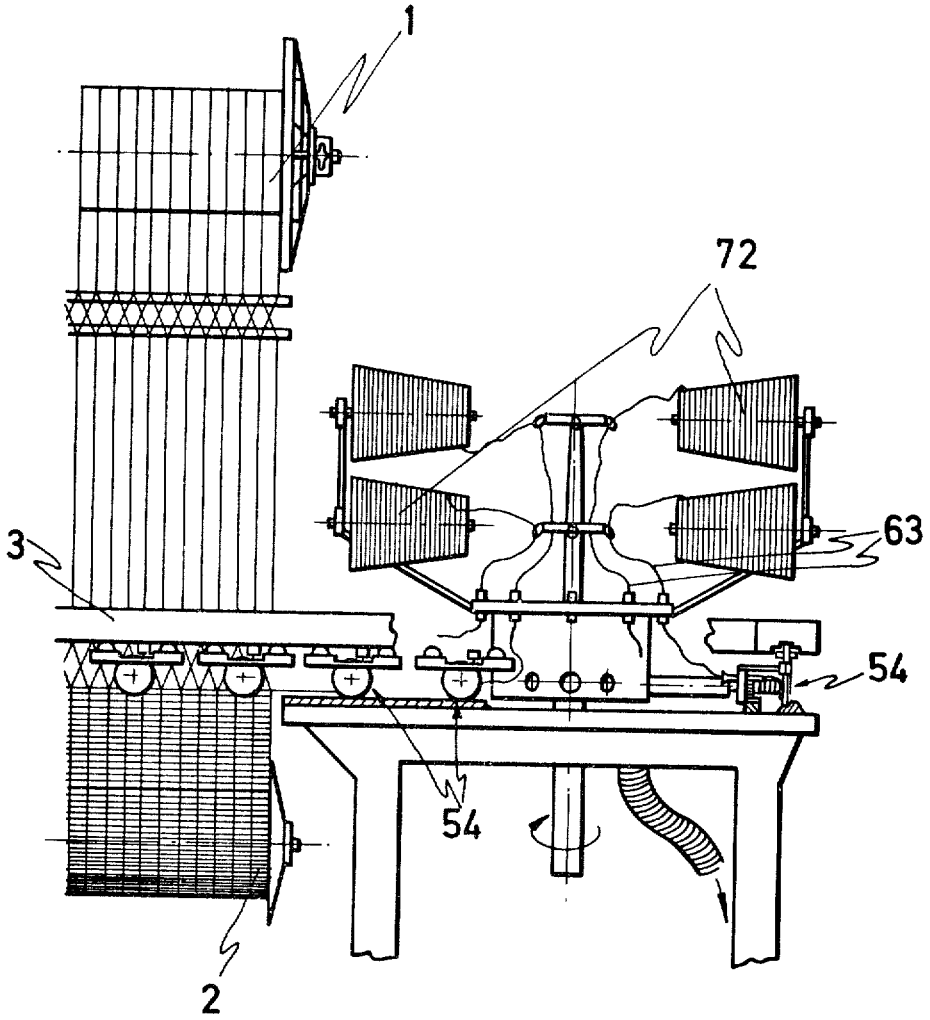
FIG. 24 is a schematic, vertical partial section of the machine taken from one of the ends thereof, further illustrating the system for feeding the weft threads to the inserters.

FIG. 24 illustrates the feeding of the inserters, wherein the pinion which moves the chains pulling the cam carriers and the cam carriers have not been illustrated in order to simplify the view. This figure shows the position occupied by the feeding bobbins 72, which are also partially represented in FIG. 2 and which can be seen at both sides of FIG. 1.

Figure 25:
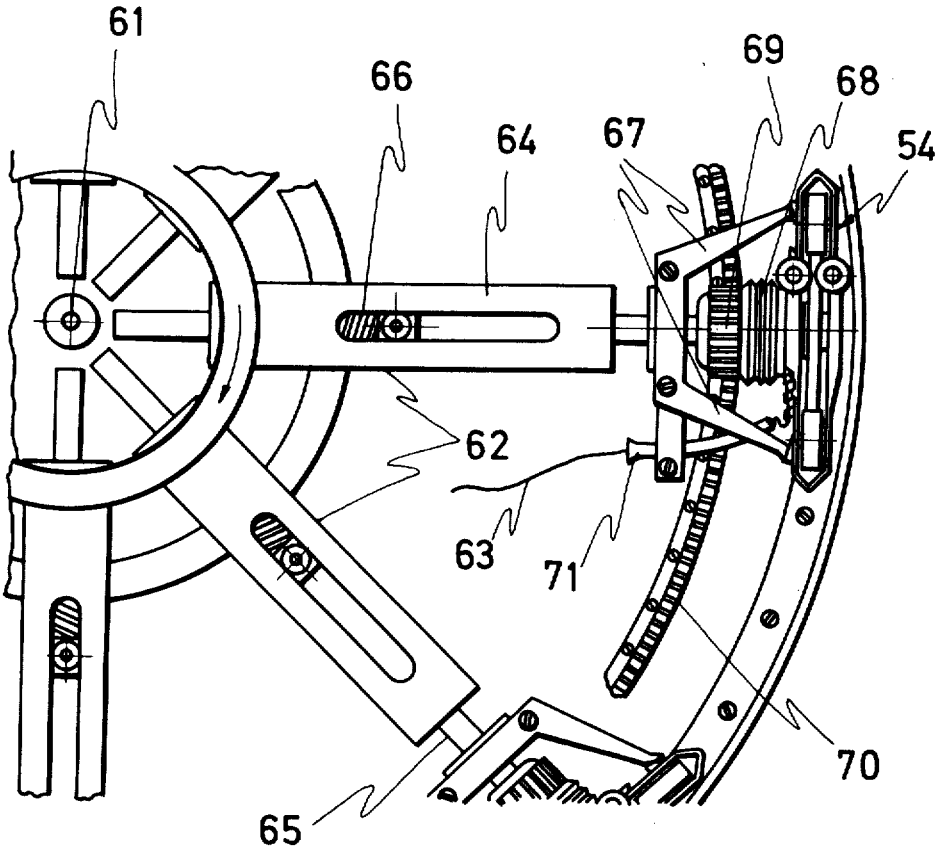
FIG. 25 is an enlarged detail plan view of a portion of FIG. 23.

FIG. 25 illustrates in functional detail one of the arms 62. It can be seen clearly in FIG. 25 how each arm 62 is coupled to an inserter 54 and how the winding bobbin 45 is coupled to the rotating head 68.

FIG. 26 shows a detailed view of one of the arms, and particularly the construction of head 68, which is a flexible bellow capable of adapting its position on the bobbin of the inserter, when coupling takes place. Head 68 also has on the outer periphery thereof a tooth 74 which, in a preferred embodiment, is coupled to anyone of a series of grooves made in the periphery of the winding bobbin of the inserter to avoid relative slipping during the winding operations.

Various modifications may be made to the above described specific structural arrangements without departing from the scope of the invention.

I claim:

1. In a continuous insertion weaving machine of the progressive shed type and including warp beam means for supplying warp threads; shed tunnel means, aligned with said warp threads passing therethrough, for continuously passing weft threads carried by inserters between said warp threads, thereby weaving a fabric; and woven fabric beam means for collecting fabric woven in said shed tunnel means; the improvement wherein:

said shed tunnel means comprises:

two separate parallel tunnels within a single frame;

first and second chain driving means, one each mounted on said frame between adjacent ends of said two tunnels;

first and second endless chains, both mounted about said first and second chain driving means, said first and second chains each having opposite non-linear runs around portions of peripheries of said first and second chain driving means, means to cause said first and second chains to be coupled to each other and coupled to said chain driving means during said non-linear runs, said first and second chains each having opposite linear runs between said non-linear runs, means to cause said first and second chains to be separated and uncoupled from each other during each of said linear runs, said first and second chains during each of said linear runs extending along opposite sides of a separate one of said two tunnels;

warp thread control means mounted within each of said tunnels; and means carried by and movable with each of said chains for continuously moving said warp thread control means transversely of said respective tunnel to thereby control the paths of said warp threads, and for continuously moving said inserters through said tunnels;

said warp beam means comprises means for supplying separate pluralities of warp threads to each of said tunnels; and said woven fabric beam means comprises first and second beams, one for collecting fabric woven in each of said tunnels.

2. The improvement claimed in claim 1, wherein said warp thread control means in each said tunnel comprises first and second alignments of plates, each said alignment extending along opposite sides of the respective said tunnel, each said alignment comprising a plurality of spaced plates extending transverse to said respective tunnel, the plates of one alignment being coplanar with corresponding plates of the other alignment; and a plurality of separate levels of healds successively positioned between adjacent plates of said first and second alignments, said healds extending transverse to said respective tunnel, each heald having an eye through which extends at least one said warp thread.

3. The improvement claimed in claim 2, wherein each said tunnel further comprising a plurality of first and second members forming teeth of the reed, said first and second members being equally configured but mirror images of each other, said first and second members being alternately positioned between spaced plates of said first and second alignments adjacent lower portions of said plates, and said first and second members extending transverse to said respective tunnel.

4. The improvement claimed in claim 3, wherein each of said first and second members has a downwardly extending projection, the projections of said first and second members defining therebetween a channel for the passage therethrough of said inserters along the said respective tunnel.

5. The improvement claimed in claim 4, wherein each of said first and second members have in opposite ends thereof recesses forming first and second level cam contacting surfaces on opposite ends of each member, each of said first and second members being movable in opposite directions transverse to said respective tunnel.

6. The improvement claimed in claim 5, wherein said moving means comprises a plurality of pairs of carriers, respective carriers of each said pair being mounted in facing relation on said first and second chains, each said pair of carriers having one of said inserters aligned therebetween.

7. The improvement claimed in claim 6, further comprising first and second level reed cams on each said carrier, said first and second level reed cams respectively contacting said first and second level cam contacting surfaces of said members, whereby upon movement of said chains and carriers along said respective tunnel said first and second members are cyclically and progressively moved transversely inwardly and outwardly of said respective tunnel, said downwardly extending projections of said first and second members thus comprising means upon inward movement of said members for contacting the respective said inserter and moving said inserter along said respective tunnel in unison with the respective said pair of carriers.

8. The improvement claimed in claim 6, further comprising heald cams on each of said carriers, the number of heald cams on the two carriers of each said pair of carriers equalling the number of levels of said healds in each said tunnel, said heald cams comprising means upon movement of said chains and carriers along said respective tunnel or cyclically and progressively moving said healds transversely of said respective tunnel, and for thereby crossing said warp threads transversely back and forth across said respective tunnel.

9. The improvement claimed in claim 6, wherein each said heald cam comprises a first belt inclined to the path of travel of the respective said carrier along said respective tunnel for progressively moving each said respective heald from a first transverse tunnel position to a second transverse tunnel position, and a second belt extending parallel to said path of travel for maintaining each said respective heald in said second transverse tunnel position for a predetermined time after passage thereby of said first belt.

10. The improvement claimed in claim 9, wherein said first and second belts share a common pulley shaft having a pinion mounted thereon, and further comprising a rack extending along the path of the respective carrier, said pinion meshing with said rack whereby movement of said carrier causes rotation of said pinion, said pulley shaft and said first and second belts.

11. The improvement claimed in claim 6, further comprising carrier tracks extending along the path of each said carrier along each said tunnel and each said carrier having tracking wheel means riding along said carrier tracks.

12. The improvement claimed in claim 1, wherein said moving means comprises a plurality of pairs of carriers, respective carriers of each said pair being mounted in facing relation on said first and second chains, each said pair of carriers having one of said inserters aligned therebetween; and further comprising, along each of said non-linear runs, a first substantially semi-circular upper guide, said carriers of each said pair of carriers being guided by said upper guide while said chains move along said respective non-linear run, said upper guide having a groove in the lower portion thereof forming a guide for an upper portion of the inserter of the respective said pair of carriers, and a second substantially semi-circular lower guide, a lower portion of the respective said inserter riding on said lower guide.

13. The improvement claimed in claim 12, wherein each said chain driving means has a rotating shaft common with a plurality of arms extending radially outwardly therefrom; each of said inserters has a frame and a weft thread bobbin mounted thereon; each of said arms having means at the outer end thereof for contacting said frame of one of said inserters; and each of said arms further having at said outer end thereof means for rewinding a weft thread on said bobbin of the respective said inserter.

14. The improvement claimed in claim 12, wherein each said arm comprises telescopically mounted inner and outer length portions, and means urging said outer length portion outwardly of said inner length portion.

15. The improvement claimed in claim 1, wherein each of said chain driving means comprises a sprocket; each of said chains is formed by links each having a substantially V-shaped configuration formed by a pair of peaks separating a valley, adjacent links of each chain being connected at adjacent said peaks; a first of said chains being meshed with the respective said sprocket along the respective said non-linear run; and the second of said chains being meshed with said first chain along the respective said non-linear run, with the connected peaks of adjacent links of said second chain riding in valleys of corresponding links of said first chain, and vice versa.

* * * * *